US009976287B2

(12) United States Patent
Kunz

(10) Patent No.: US 9,976,287 B2
(45) Date of Patent: May 22, 2018

(54) GROUND ENGAGING TOOL

(71) Applicant: CATERPILLAR INC., Peoria, IL (US)

(72) Inventor: Phillip John Kunz, Morton, IL (US)

(73) Assignee: Caterpillar Inc., Deerfield, IL (US)

( * ) Notice: Subject to any disclaimer, the term of this patent is extended or adjusted under 35 U.S.C. 154(b) by 0 days. days.

(21) Appl. No.: 14/941,297

(22) Filed: Nov. 13, 2015

(65) Prior Publication Data

US 2016/0160474 A1 Jun. 9, 2016

Related U.S. Application Data

(60) Provisional application No. 62/086,981, filed on Dec. 3, 2014.

(51) Int. Cl.
*E02F 9/28* (2006.01)

(52) U.S. Cl.
CPC ..... *E02F 9/2841* (2013.01); *E02F 9/2825* (2013.01)

(58) Field of Classification Search
CPC ..... E02F 9/2833; E02F 9/2841; E02F 9/2858; E02F 9/2891; E02F 9/2825; E02F 9/2883; E05B 47/0012; E05B 2047/0091; Y10T 403/58; Y10T 403/7069; Y10T 403/7079
USPC ..... 37/446, 450–460; 172/772, 772.5, 172/701.1–701.3; 403/150, 153, 297, 403/355; 299/109, 111, 113
See application file for complete search history.

(56) References Cited

U.S. PATENT DOCUMENTS

| | | | | |
|---|---|---|---|---|
| 5,913,605 | A * | 6/1999 | Jusselin | E02F 9/28 172/772 |
| 6,131,642 | A | 10/2000 | Welfonder | |
| 6,581,815 | B1 | 6/2003 | Ho et al. | |
| 6,598,909 | B2 * | 7/2003 | Lu | E05B 47/0012 292/144 |
| 7,762,015 | B2 | 7/2010 | Smith et al. | |
| 8,122,623 | B1 * | 2/2012 | Hughes | E02F 9/2825 37/457 |

FOREIGN PATENT DOCUMENTS

| | | |
|---|---|---|
| CN | 203924200 | 11/2014 |
| EP | 2241683 | 10/2010 |
| EP | 2620557 | 7/2013 |
| WO | WO 2013/090996 A1 | 6/2013 |

* cited by examiner

*Primary Examiner* — Robert E Pezzuto
(74) *Attorney, Agent, or Firm* — Finnegan, Henderson, Farabow, Garrett & Dunner, LLP

(57) ABSTRACT

A ground engaging tool includes an interior surface. The tool may also have an exterior surface defining a front edge of the tool. In addition, the tool may have a rear surface substantially opposite the front edge. The rear surface may connect the interior surface to the exterior surface. The tool may also have a lock opening surface. The lock opening surface may define a lock opening extending from the interior surface, through the tool, to the exterior surface. The lock opening surface may have a generally circular inner portion adjacent the interior surface. The inner portion may define a groove in the tool positioned circumferentially around the lock opening. In addition, the inner portion may define at least one detent recess in the tool along the groove. The lock opening surface may also have a generally circular outer portion adjacent the exterior surface.

14 Claims, 14 Drawing Sheets

GROUND ENGAGING TOOL

CROSS-REFERENCE TO RELATED APPLICATION

This application claims the benefit of U.S. Provisional Patent Application No. 62/086,981, filed Dec. 3, 2014, which is hereby incorporated by reference in its entirety.

TECHNICAL FIELD

The present disclosure relates generally to a ground engaging tool and, more particularly, to a ground engaging tool that is removably attachable to an earth-working machine.

BACKGROUND

Earth-working machines, such as, for example, excavators, wheel loaders, hydraulic mining shovels, cable shovels, bucket wheels, bulldozers, and draglines, are generally used for digging or ripping into the earth or rock and/or moving loosened work material from one place to another at a worksite. These earth-working machines include various earth-working implements, such as a bucket or a blade, for excavating or moving the work material. These implements can be subjected to extreme wear from the abrasion and impacts experienced during the earth-working applications.

To protect these implements against wear, and thereby prolong the useful life of the implements, various ground engaging tools, such as teeth, edge protectors, and other wear members, can be provided on the earth-working implements in the areas where the most damaging abrasions and impacts occur. These ground engaging tools are removably attached to the implements using customized retainer systems, so that worn or damaged ground engaging tools can be readily removed and replaced with new ground engaging tools.

Many retainer systems have been proposed and used for removably attaching various ground engaging tools to earth-working implements. One example of such a retainer system is disclosed in U.S. Pat. No. 7,762,015 to Smith et al. The system includes a rotating lock having a slot for receiving a post of an adapter that is mounted to or part of a work tool. The lock is positioned in a retainer bushing, which is positioned in a lock cavity of a ground engaging tool. When the lock is rotated, the entrance to the slot is blocked and the post cannot slide out of the slot, locking the ground engaging tool to the work tool.

Many problems and/or disadvantages still exist with known retainer systems. Various embodiments of the present disclosure may solve one or more of the problems and/or disadvantages.

SUMMARY

According to one exemplary aspect, the present disclosure is directed to a ground engaging tool. The tool may include an interior surface. The tool may also include an exterior surface defining a front edge of the tool. In addition, the tool may include a rear surface substantially opposite the front edge. The rear surface may connect the interior surface to the exterior surface. The tool may also include a lock opening surface. The lock opening surface may define a lock opening extending from the interior surface, through the tool, to the exterior surface. The lock opening surface may include a generally circular inner portion adjacent the interior surface.

The inner portion may define a groove in the tool positioned circumferentially around the lock opening. In addition, the inner portion may define at least one detent recess in the tool along the groove. The lock opening surface may also include a generally circular outer portion adjacent the exterior surface.

In another exemplary aspect, the present disclosure is directed to a ground engaging tool assembly. The assembly may include a ground engaging tool and a lock for the tool. The tool may include an interior surface. The tool may also include an exterior surface defining a front edge of the tool. In addition, the tool may include a rear surface substantially opposite the front edge, and connecting the interior surface to the exterior surface. The tool may also include a lock opening surface, which may define a lock opening extending from the interior surface, through the tool, to the exterior surface. The lock opening surface may include a generally circular inner portion adjacent the interior surface. The inner portion may define a groove in the tool positioned circumferentially around the lock opening. In addition, the inner portion may define at least one detent recess in the tool along the groove. The lock opening surface may also include a generally circular outer portion adjacent the exterior surface. The lock may include a head portion with at least one compressible detent projection. The lock may also include a C-shaped skirt extending from the head portion. The skirt may define a lock slot for receiving a post to be locked with the tool.

In still another exemplary aspect, the present disclosure is directed to a ground engaging tool assembly. The assembly may include a ground engaging tool and a lock for the tool. The tool may include an interior surface. The tool may also include an exterior surface defining a front edge of the tool. In addition, the tool may include a rear surface substantially opposite the front edge, and connecting the interior surface to the exterior surface. The tool may also include a lock opening surface, which may define a lock opening extending from the interior surface, through the tool, to the exterior surface. The lock opening surface may include a generally circular inner portion adjacent the interior surface. The inner portion may define a groove in the tool positioned circumferentially around the lock opening. In addition, the inner portion may define at least one detent recess in the tool along the groove. The lock opening surface may also include a generally circular outer portion adjacent the exterior surface. The lock may include a head portion with at least one detent projection, The detent projection may have an at least partially sphere-shaped portion. The lock may also have a C-shaped skirt extending from the head portion. The skirt may define a lock slot for receiving a post to be locked with the tool.

DETAILED DESCRIPTION

Figure 1:
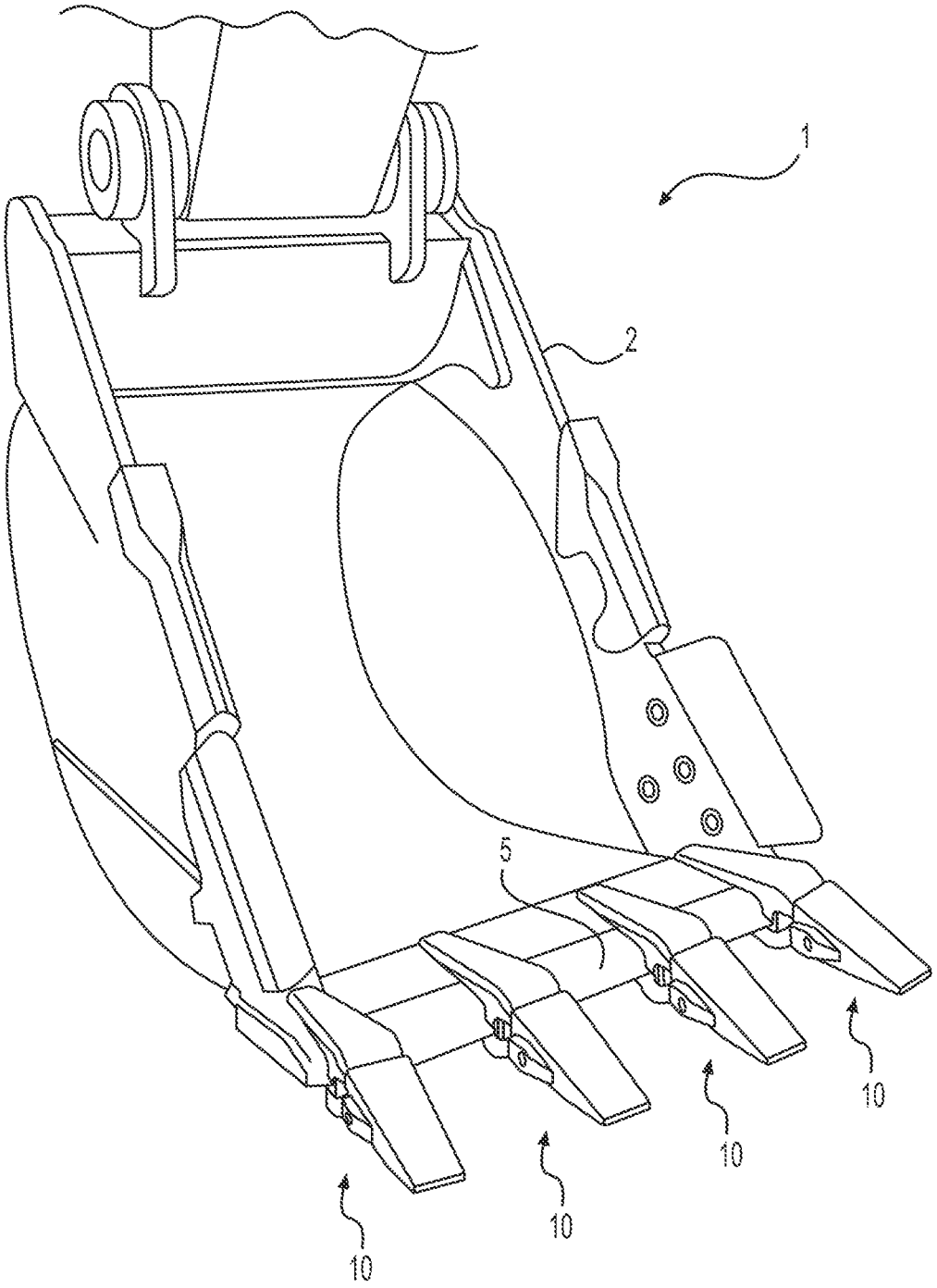
FIG. 1 is a perspective view of a loader bucket having a plurality of ground engaging tools attached thereto according to one exemplary embodiment of the present disclosure.

FIG. 1 illustrates an excavator bucket assembly 1 as an exemplary implement of an earth-working machine. Excavator bucket assembly 1 includes a bucket 2 used for excavating work material in a known manner. Bucket 2 may include a variety of ground engaging tools. For example, bucket 2 may include a plurality of tooth assemblies 10, as ground engaging tools, attached to a base edge 5 of bucket 2. Tooth assemblies 10 may be secured to bucket 2 employing retainer systems according to the present disclosure. While various embodiments of the present disclosure will be described in connection with a particular ground engaging tool assembly (e.g., tooth assembly 10), it should be understood that the present disclosure may be applied to, or used in connection with, any other type of ground engaging tools or components. Further, it should be understood that one or more features described in connection with one embodiment can be implemented in any of the other disclosed embodiments unless otherwise specifically noted.

Figure 2:
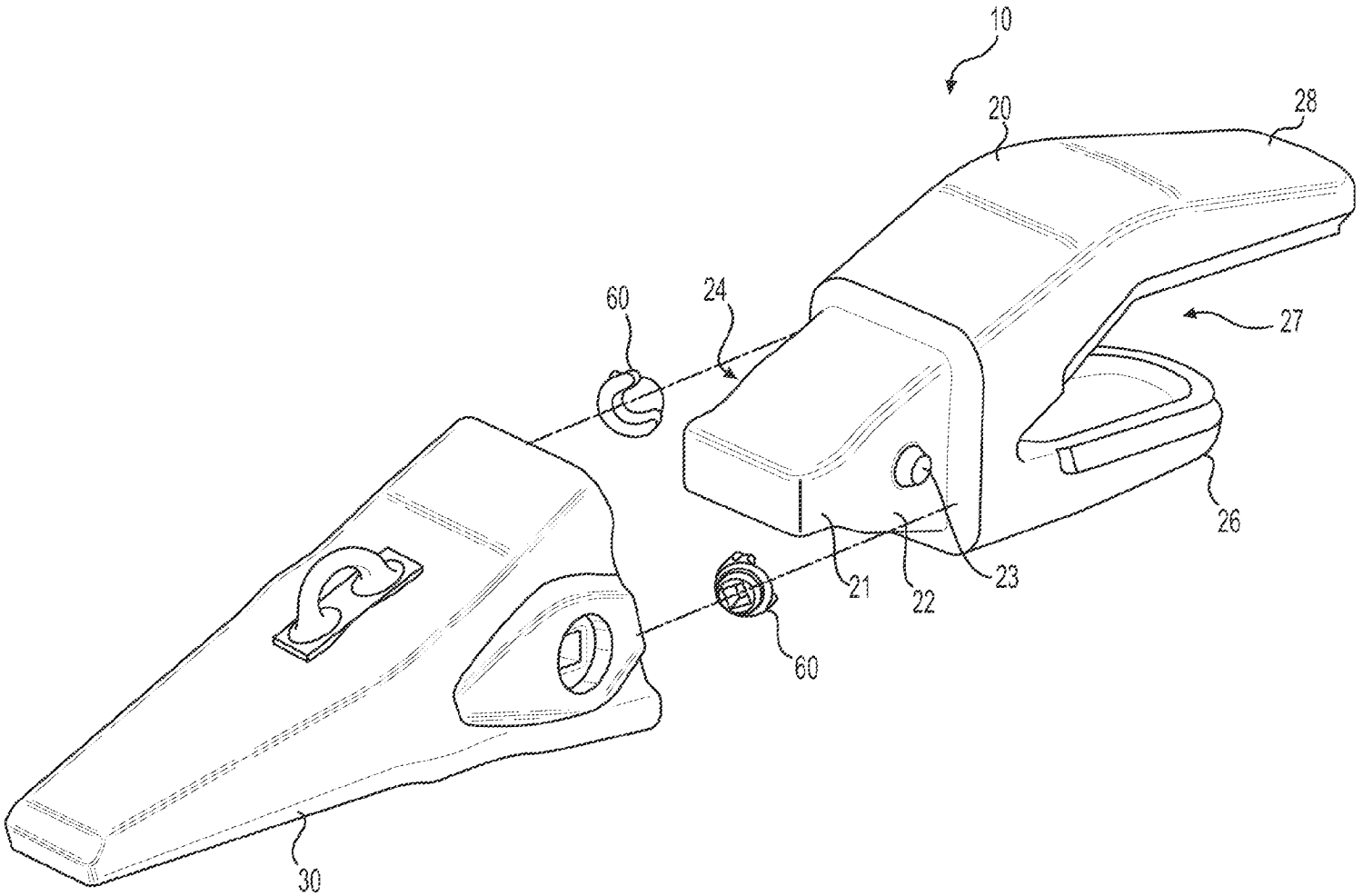
FIG. 2 is a perspective view of a tooth assembly according to one exemplary embodiment of the present disclosure.

Referring to FIG. 2, tooth assembly 10 may include an adapter 20 configured to engage base edge 5 of bucket 2 or other suitable support structure of an implement. Tooth assembly 10 may also include a ground-engaging tip 30 configured to be removably attached to adapter 20. Tooth assembly 10 may further include a lock 60 configured to secure tip 30 to adapter 20. Tip 30 may endure the majority of the impact and abrasion caused by engagement with work material, and wear down more quickly and break more frequently than adapter 20. Consequently, multiple tips 30 may be attached to adapter 20, worn down, and replaced before adapter 20 needs to be replaced. As will be detailed herein, various exemplary embodiments of lock 60, consistent with the present disclosure, may facilitate attachment and detachment of ground engaging tools to and from the support structure of an implement.

Adapter 20 may include a pair of first and second mounting legs 26, 28 defining a recess 27 therebetween for receiving base edge 5. Adapter 20 may be secured in place on base edge 5 by attaching first mounting leg 26 and second mounting leg 28 to base edge 5 using any suitable connection method. For example, mounting legs 26 and 28 and base edge 5 may have corresponding apertures (not shown) through which any suitable fasteners such as bolts or rivets may be inserted to hold adapter 20 in place. Alternatively or additionally, mounting legs 26 and 28 may be welded to the corresponding top and bottom surfaces of base edge 5. Any other connection method and/or configuration known in the art may be used alternatively or additionally. For example, in some exemplary embodiments, an adapter may be configured to use any of the retainer systems disclosed herein to secure the adapter to a suitable support structure of an implement.

Adapter 20 may include a nose 21 extending in a forward direction. Nose 21 may be configured to be received in a mounting cavity 35 of tip 30, shown in FIG. 3. Nose 21 may be configured to support tip 30 during use of bucket 2 and to facilitate retention of tip 30 on nose 21 when bearing the load of the work material. Nose 21 may include an integral post 23 extending from each lateral side 22, 24. Post 23 may have various shapes and sizes. In one exemplary embodiment, as shown in FIG. 2, post 23 may have a frustoconical shape. As will be described in more detail herein, posts 23 may cooperate with locks 60 to secure tip 30 to adapter 20.

Figure 3:
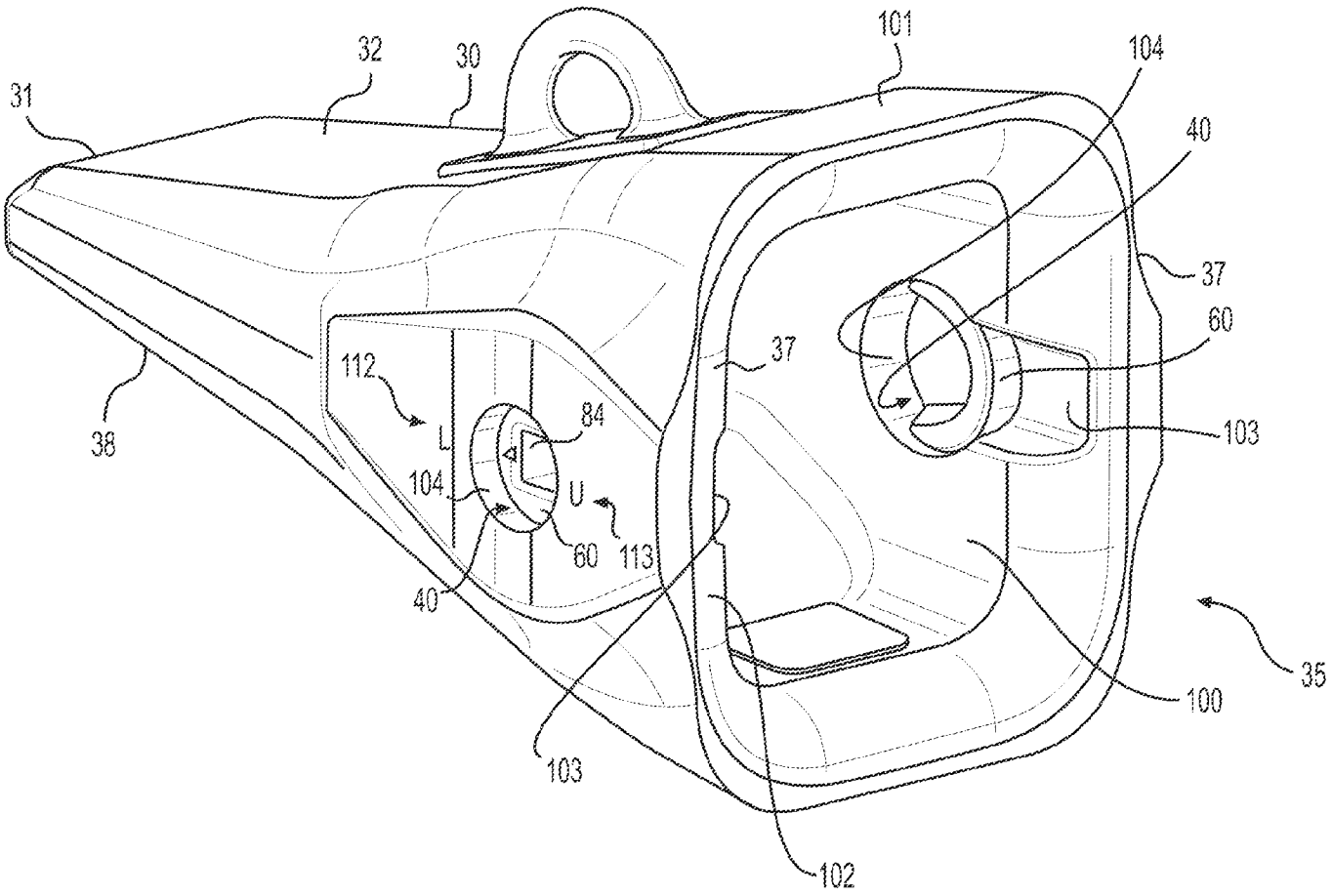
FIG. 3 is a perspective view of a tip of the tooth assembly shown in FIG. 2, with a lock positioned in a lock opening of the tip.

As shown in the rear view of tip 30 in FIG. 3, tip 30 may include an interior surface 100, which may define mounting cavity 35, an exterior surface 101, and a rear surface 102, which may connect interior surface 100 to exterior surface 101. As shown in FIG. 2, exterior surface 101 may generally taper as it extends forward. For example, an upper portion 32 of exterior surface 101 may slope downward as it extends forward, and a lower portion 38 of exterior surface 101 may extend generally upward as it extends forward. Alternatively, lower portion 38 may extend generally straight or downward as it extends forward. At its forward end, substantially opposite of rear surface 102, exterior surface 101 may define a wedge-shaped front edge 31 of tip 30.

As mentioned above, tip 30 may be secured to adapter 20 via lock 60. Tip 30 may have various configurations for accommodating adapter 20 and lock 60. For example, in the exemplary embodiment shown in FIGS. 3 and 5, interior surface 100 may define slots 103 recessed into tip 30's lateral sides 37 to receive posts 23 of adapter 20. In addition, as shown in FIGS. 3-6, a lock opening surface 104 in each of tip 30's lateral sides 37 may define a lock opening 40, into which one of slots 103 may extend from rear surface 102. Lock opening 40 may extend from interior surface 100, through side 37, to exterior surface 101, and may house lock 60 and a post 23 received via the one of slots 103. While the exemplary embodiment shown in FIGS. 2, 3, and 5 has two lock opening surfaces 104 (and two lock openings 40) on opposite lateral sides 37 of tip 30, tip 30 may have different numbers and/or arrangements of lock opening surfaces 104 (and lock openings 40). For example, in some embodiments, tip 30 may have more than one lock opening surface 104 (and lock opening 40) on each lateral side 37, or may have a lock opening surface 104 (and lock opening 40) on only a single lateral side 37.

Figure 4:
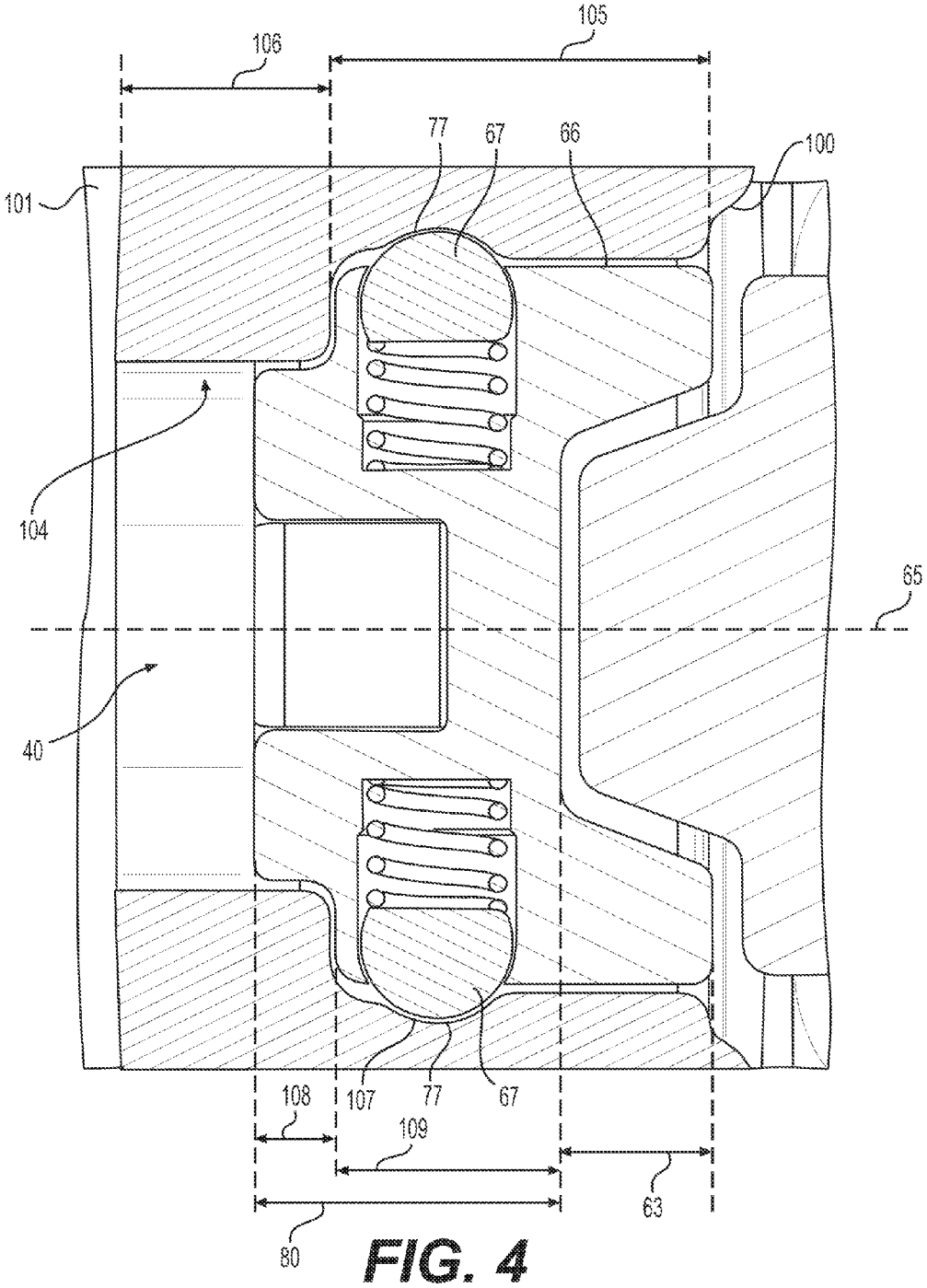
FIG. 4 is a partial cross-sectional view of the tooth assembly of FIG. 2 in an assembled state.
Figure 5:
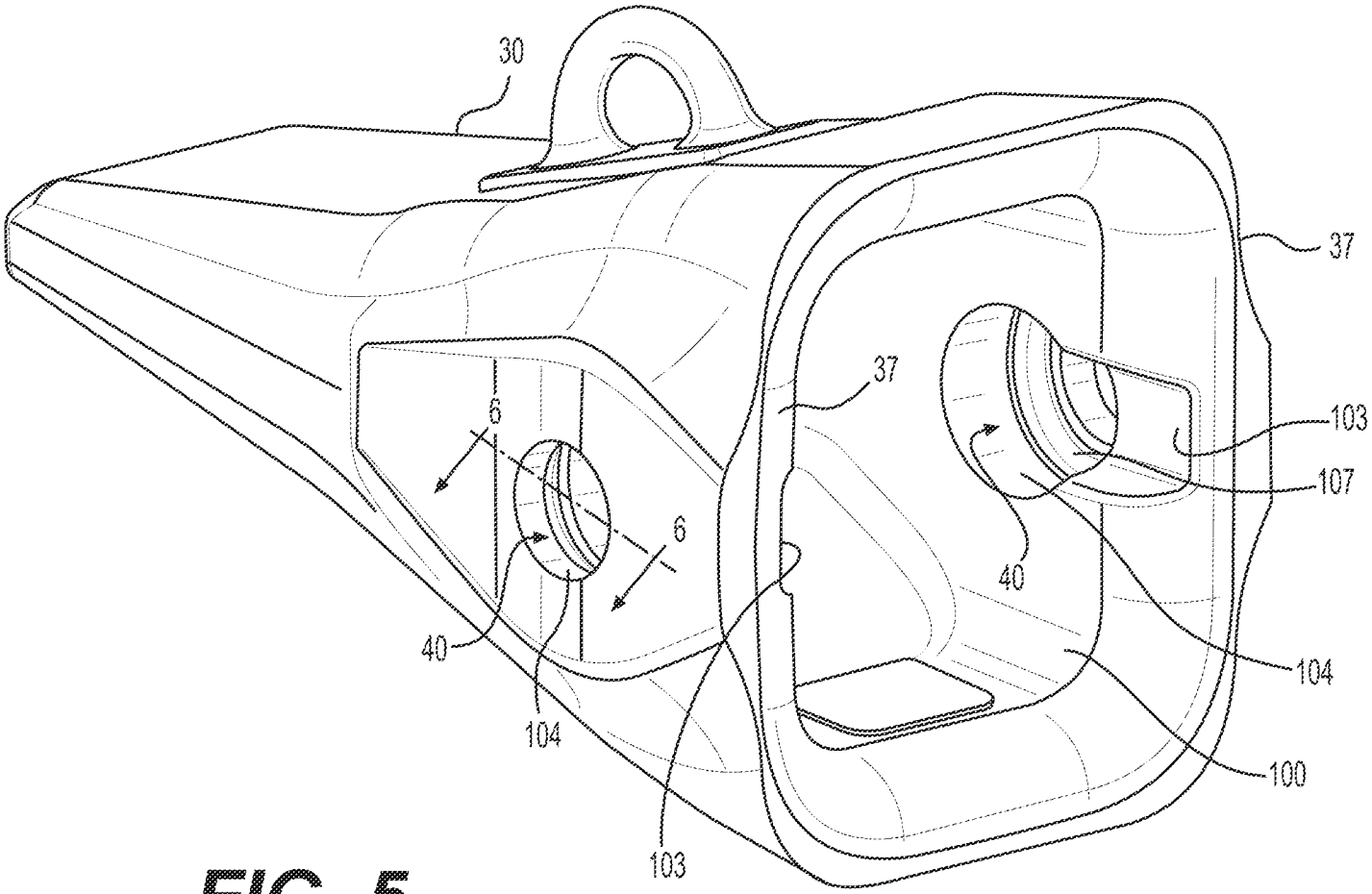
FIG. 5 is a perspective view of the tip of FIG. 3, without a lock positioned in any lock opening of the tip.
Figure 6:
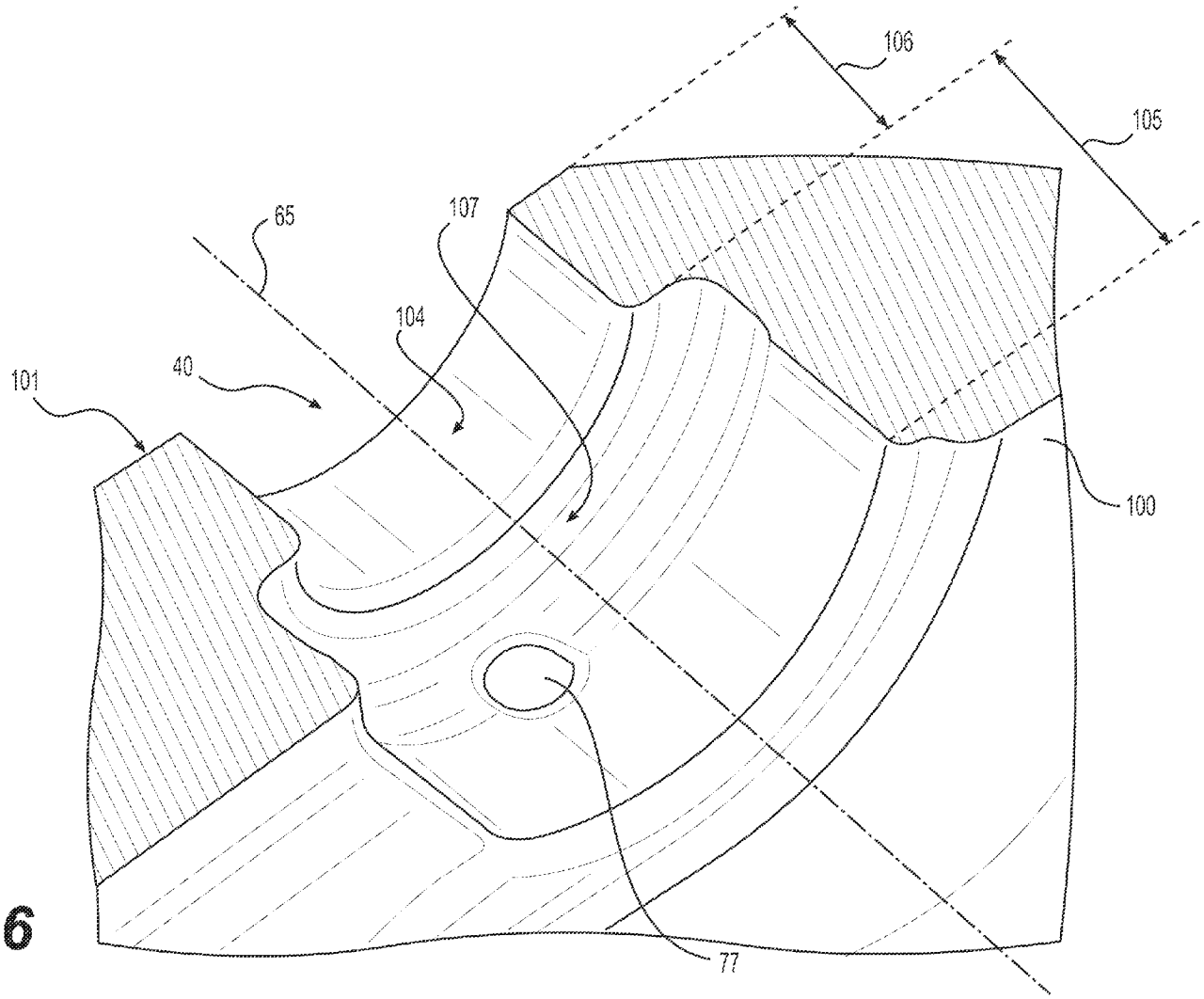
FIG. 6 is a partial cutaway view of one of the openings of the tip of FIG. 5.

As best shown in FIGS. 4-6, lock opening surface 104 may include a generally circular inner portion 105 and a generally circular outer portion 106. Inner portion may be adjacent interior surface 100, while outer portion 106 may be adjacent exterior surface 101. In some embodiments, portions 105 and 106 may be generally cylindrical. In these embodiments, outer portion 106 may have a smaller diameter than inner portion 105 to prevent lock 60 from passing all the way through lock opening 40. In other embodiments, one or both of portions 105 and 106 may be generally frustoconical to prevent lock 60 from passing all the way through lock opening 40.

In some embodiments, inner portion 105 may be configured to guide and intermittently inhibit rotation of lock 60 within lock opening 40. For example, inner portion 105 may define a groove 107 in tip 30 positioned circumferentially around lock opening 40. Groove 107 may interact with one or more detent projections 67 of lock 60 to ensure lock 60 rotates about lock rotation axis 65 (referring to FIGS. 4 and 6) and does not fall out of lock opening 40. In some embodiments, groove 107 may interact with the one or more detent projections 67 to ensure lock 60 does not fall out of lock opening 40 regardless of how lock 60 is rotated. In other embodiments, inner portion 105 may define one or more channels (not shown) extending from groove 107 to interior surface 100 to allow lock 60 to fall out of lock opening 40 when lock 60 is rotated to certain positions in which the one or more detent projections 67 align with the one or more channels. Inner portion 105 may also define at least one detent recess 77 in tip 30 along groove 107, which may interact with one or more detent projections 67 of lock 60 to inhibit rotation of lock 60 when engaged by the one or more detent projections 67. For example, inner portion 105 may define two detent recesses 77 in tip 30 along groove 107. These detent recesses 77 may be spaced apart from one another by approximately 180 degrees to intermittently inhibit rotation of lock 60 at 180 degree intervals.

Figure 7:
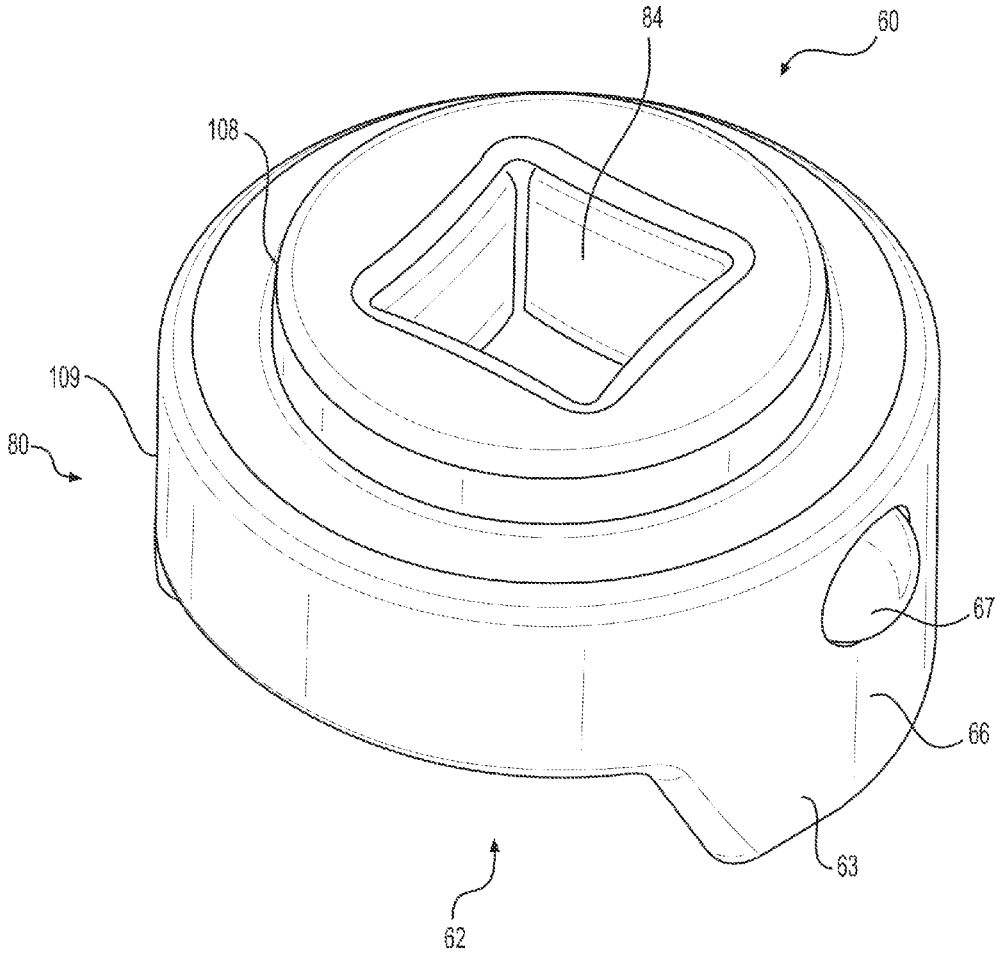
FIG. 7 is a perspective view of a lock according to one exemplary embodiment of the present disclosure.

As shown in FIGS. 4, 6, and 7, detent recesses 77 may be shaped like detent projections 67 to optimize engagement with detent projections 67. For example, detent recesses 77 may be at least partially sphere-shaped to optimize engagement with detent projections 67 that are at least partially sphere-shaped. Alternatively, detent recesses 77 may be otherwise shaped. For example, detent recesses 77 may be at least partially football- or bullet-shaped if detent projections 67 are at least partially football- or bullet-shaped.

As mentioned above, lock opening 40 may house and allow rotation of lock 60 about lock rotation axis 65. As best shown in FIGS. 4 and 7, lock 60 may include a head portion 80, which may have a top section 108 and a bottom section 109. In addition, lock 60 may include a C-shaped skirt 63 extending from bottom section 109, and defining a lock slot 62 for receiving post 23. In conjunction with top and bottom sections 108, 109 of head portion 80, skirt 63 may define an outer surface 66 of lock 60, which may be configured to be rotatably received in lock opening 40 of tip 30. For example, outer surface 66 may have substantially the same cylindrical (as shown) or frustoconical profile as lock opening 40. In particular, outer surface 66 may be circular and extend circumferentially around lock rotation axis 65. While head portion 80's portion of outer surface 66 may extend completely around lock rotation axis 65, skirt 63's portion of outer surface 66 may extend only partway around lock rotation axis 65. With outer surface 66 of lock 60 so configured, lock 60 may be seated within lock opening 40 with top section 108's portion of outer surface 66 mated to outer portion 106 of lock opening 40, and the remainder of outer surface 66 mated to inner portion 105 of lock opening 40. As shown in FIG. 4, when lock 60 is so positioned within lock opening 40, lock rotation axis 65 may be approximately perpendicular to the part of exterior surface 101 of tip 30 surrounding lock opening 40. Alternatively, lock rotation axis 65 may be otherwise angled relative to this part of exterior surface 101.

As mentioned above, lock 60 may include one or more detent projections 67, which may interact with groove 107 and detent recesses 77 of tip 30 to guide and intermittently inhibit rotation of lock 60 within lock opening 40. As best shown in FIGS. 4 and 7, bottom section 109 of head portion 80 of lock 60 may include these detent projections 67. For example, bottom section 109 may include two at least partially spherically-shaped detent projections 67, which may be spaced apart from one another by approximately 180 degrees. Alternatively, bottom section 109 may include another number of detent projections 67, and such detent projections 67 may or may not be approximately equally spaced along a circumference of bottom section 109. In yet another alternative, detent projections may be otherwise shaped. For example, detent projections 67 may be football- or bullet-shaped.

According to one exemplary embodiment, both tip 30 and lock 60 may be constructed of metal. In order to facilitate engagement/disengagement of detent projections 67 and detent recesses 77, detent projections 67 may thus be compressible. That is, while detent projections 67 may typically project outward from outer surface 66 of lock 60 by a distance 110 (referring to FIG. 9), detent projections 67 may be compressed so as to project outward from outer surface 66 by a distance smaller than distance 110. Such compression may allow detent projections 67 to slide along inner portion 105 of lock opening surface 104 as lock 60 is inserted into lock opening 40 in a direction approximately parallel to lock rotation axis 65. Once lock 60 is fully inserted, detent projections 67 may expand and engage groove 107. Such engagement may prevent lock 60 from falling out of lock opening 40. As lock 60 is rotated, detent projections may slide along groove 107, eventually further expanding and engaging detent recesses 77 of tip 30. Such engagement may inhibit further rotation of lock 60. Further rotation and/or removal of lock 60 may, however, be accomplished by compressing detent projections 67, thereby allowing detent projections to disengage detent recesses 77 and/or groove 107.

Figure 8:
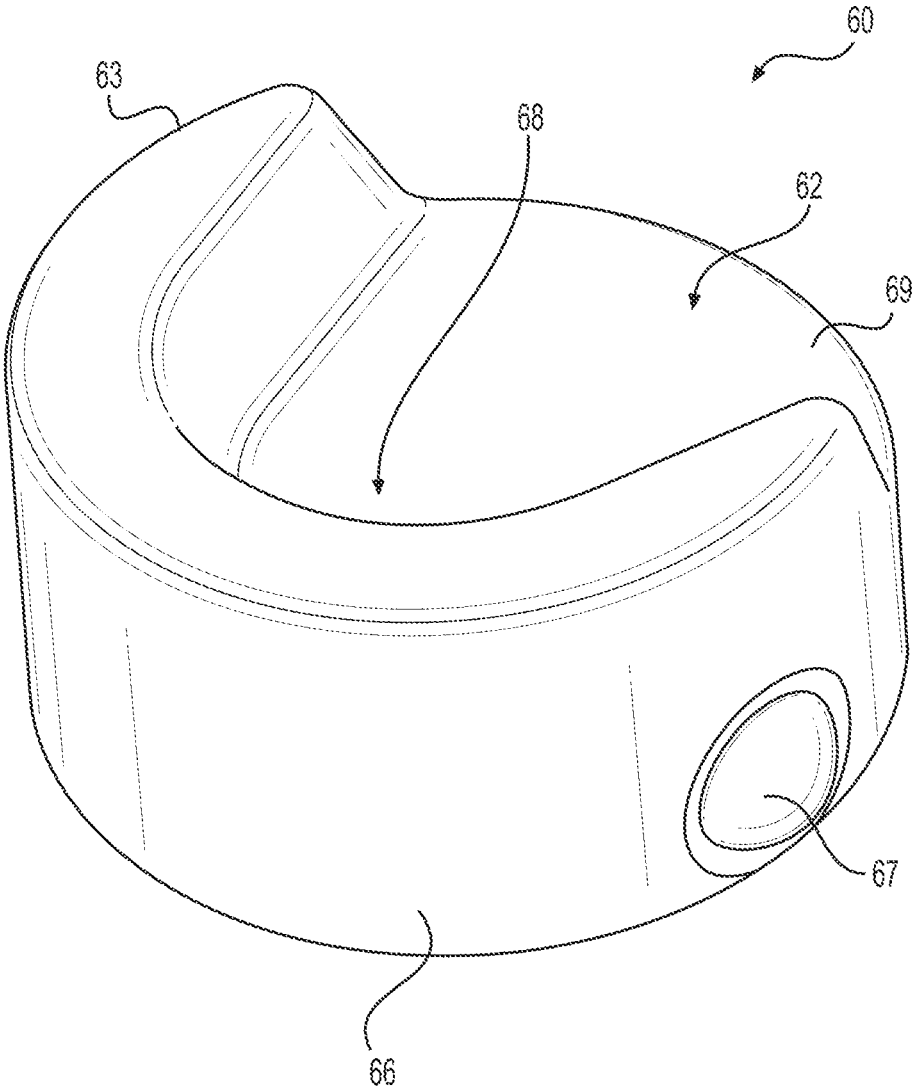
FIG. 8 is another perspective view of the lock of FIG. 7.
Figure 10:
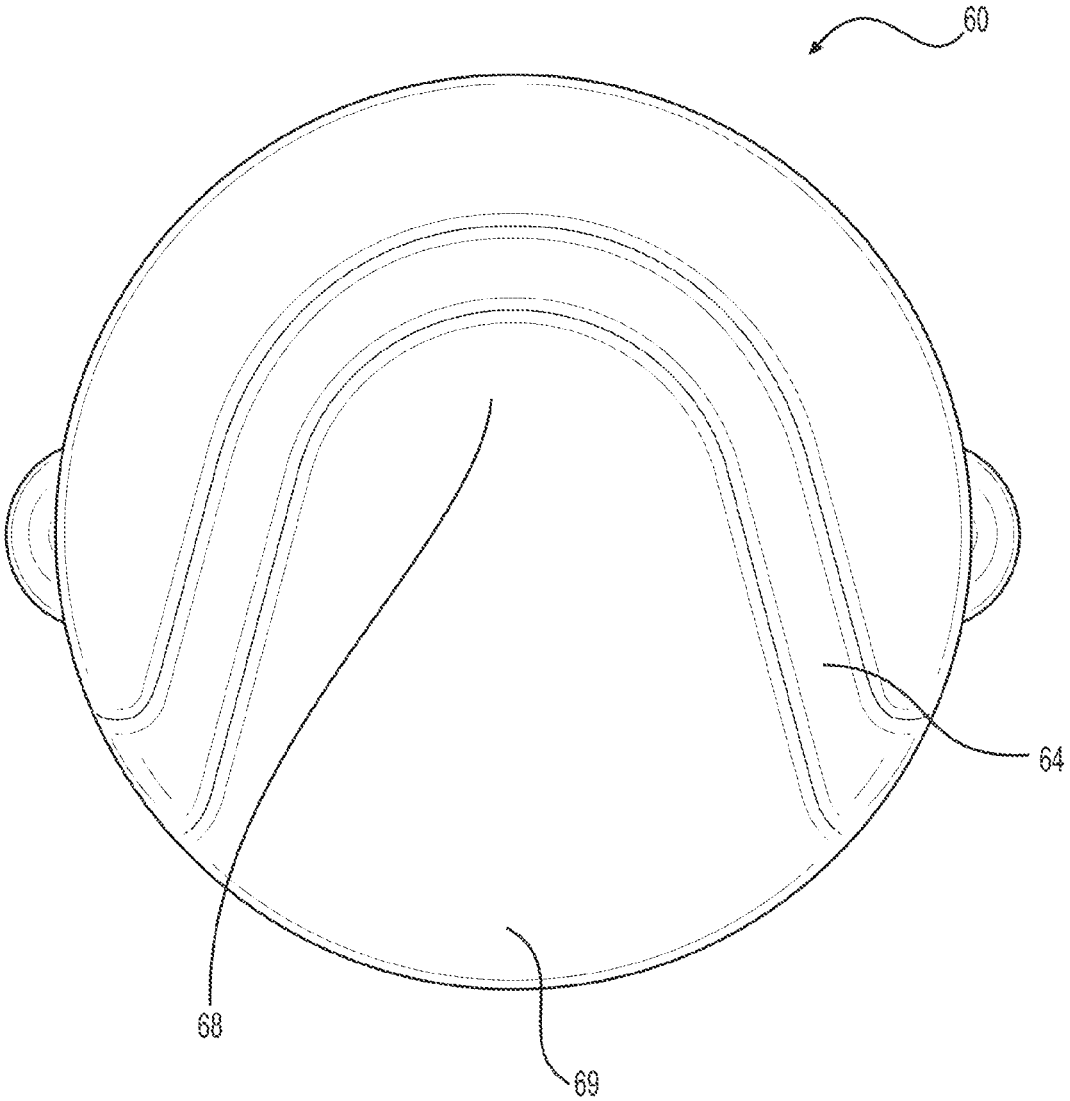
FIG. 10 is a bottom view of the lock of FIG. 7.

Lock 60 may be configured to receive at least part of post 23 of adapter 20. For example, as best shown in FIGS. 8 and 10, lock slot 62 may have an open end 69 between two circumferential ends of skirt 63 and a closed end 68 adjacent a middle portion of skirt 63. In some embodiments, lock slot 62 may have a size and shape such that it can receive frustoconical post 23 of adapter 20. The inner surface 64 of skirt 63 may be sloped so as to mate with frustoconical post 23 of adapter 20 adjacent closed end 68 of lock slot 62.

As mentioned above, lock 60 may be installed in lock opening 40 with outer surface 66 of lock 60 mated to lock opening surface 104 and detent projections 67 of lock 60 engaging detent recesses 77 of tip 30. When lock 60 is disposed in this position, open end 69 of lock slot 62 may face rearward. This position allows sliding insertion and removal of post 23 into and out of lock slot 62 through open end 69. Accordingly, this position of lock 60 may be considered an unlocked position.

To lock post 23 inside lock slot 62, lock 60 may be rotated about lock rotation axis 65 to a locked position. In this locked position, the portion of lock skirt 63 adjacent closed end 68 may preclude sliding movement of post 23 relative to lock slot 62, thereby preventing sliding movement of tip 30 relative to adapter 20. The locked position of lock 60 may be approximately 180 degrees from the unlocked position about lock rotation axis 65. In the locked position, as in the unlocked position, detent projections 67 of lock 60 may engage detent recesses 77 of tip 30, which may releasably hold lock 60 in the locked position.

In some embodiments, lock 60 and tip 30 may be configured to provide an indication of the unlocked/locked positions. For example, as shown in FIG. 3, lock 60 may include a triangle 111 on its head portion 80, and tip 30 may include lock/unlock indicators 112, 113 on its exterior surface 101 near lock opening 40. When triangle 111 points to lock indicator 112, lock 60 may be in the locked position. In contrast, when triangle 111 points to unlocked indicator 113, lock 60 may be in the unlocked position.

Figure 9:
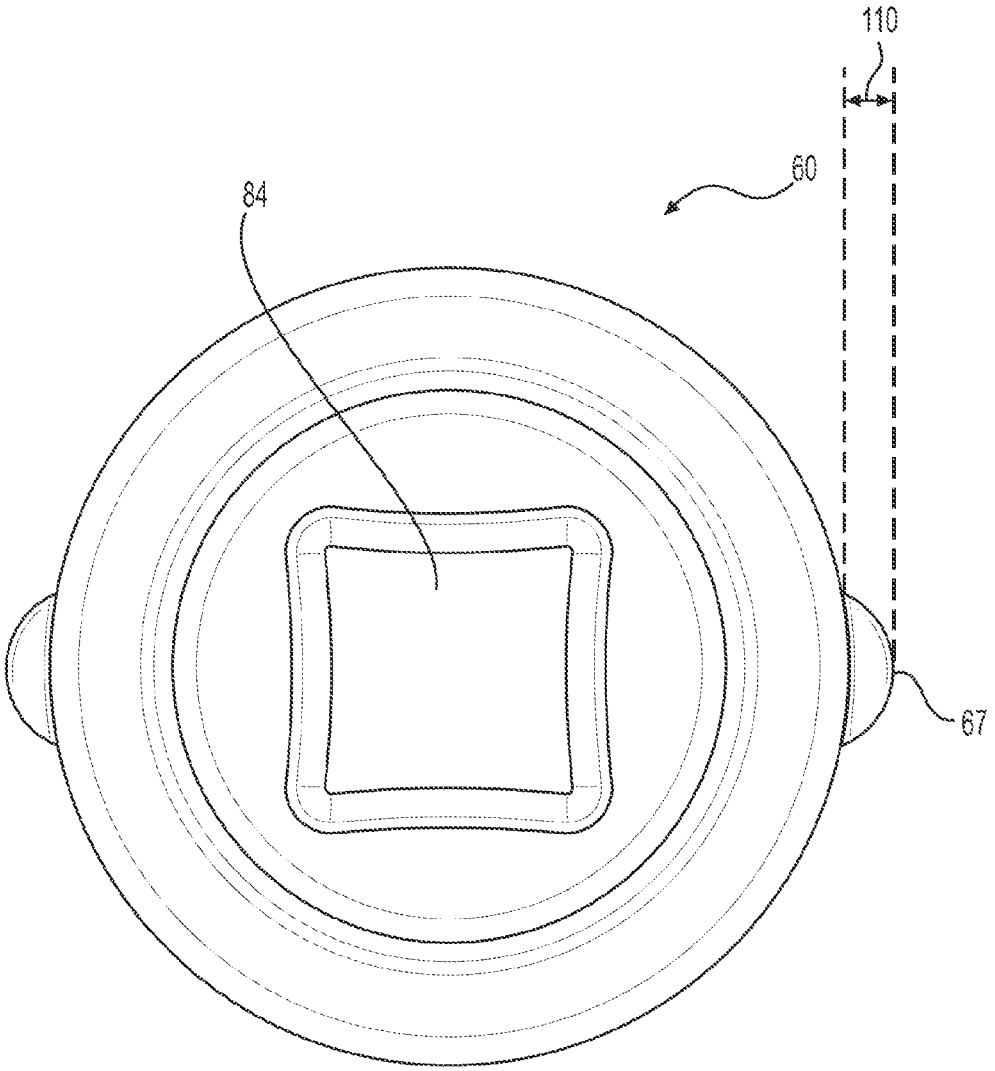
FIG. 9 is a top view of the lock of FIG. 7.

Referring to FIGS. 3, 7, and 9, lock 60 may also include a tool interface 84 in head portion 80 to facilitate rotating lock 60 about lock rotation axis 65. Tool interface 84 may include any type of features configured to be engaged by a tool for applying torque to lock 60 about lock rotation axis 65. For example, tool interface 84 may include a socket recess with a cross-section configured to engage a socket driver, such as a socket wrench. When lock 60 is seated within lock opening 40, head portion 80 defining tool interface 84 may extend at least partially through lock opening 40, and lock opening 40 may provide an access opening for a tool to engage tool interface 84.

Ground engaging tools and the associated retainer systems of the present disclosure are not limited to the exemplary configurations described above. For example, ground engaging tool assembly 10 may employ a different number and configuration of lock openings 40, posts 23, and/or locks 60. Additionally, in lieu of adapter 20 and posts 23, ground engaging tool assembly 10 may employ one or more pins fixed to or integrally formed with suitable support structure.

Certain exemplary aspects of the present disclosure may provide various alternative and/or additional configurations of retainer systems for removably attaching ground engaging tools to suitable support structure of an implement. For example, further modifications to a lock may be possible to improve the performance of or reduce costs associated with the retention system. In the following descriptions, various embodiments of the lock are disclosed.

It should be noted that, in the description of the following embodiments, only the features that are different from the above-described embodiments are highlighted, and the detailed description of the features that are common to the above-described embodiments are omitted herein.

Figure 11:
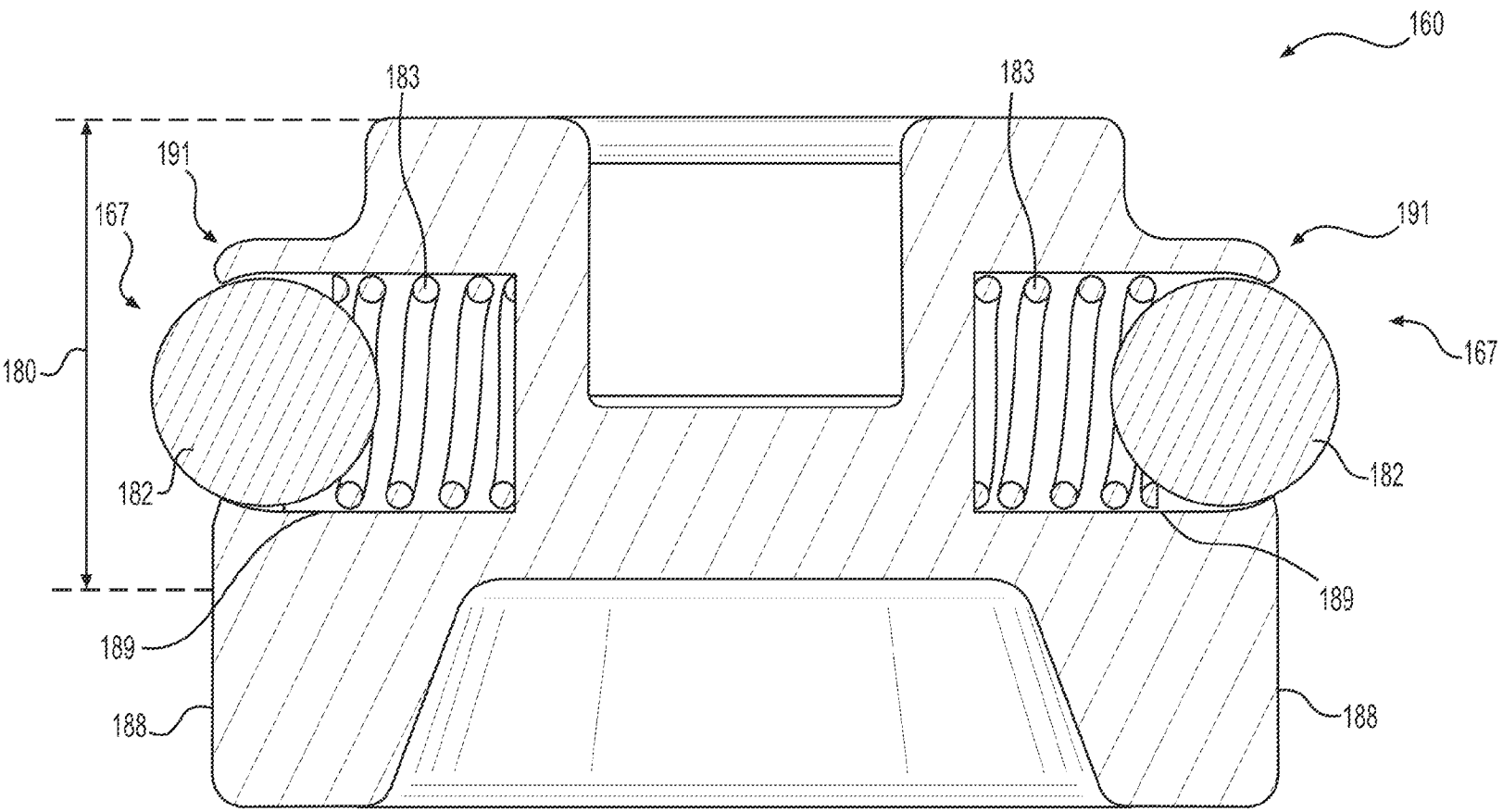
FIG. 11 is a cross-sectional view of a lock according to another exemplary embodiment of the present disclosure.

FIG. 11 illustrates a lock 160 according to one exemplary embodiment. Lock 160 may include an integrally formed head portion 180. As shown in FIG. 11, detent projections 167 of lock 160 may include at least partially sphere-shaped portions 182 at least partially situated within bores 189 of lock 160. In addition, detent projections 167 may include elastomeric portions 183 situated within bores 189. Elastomeric portions 183 may bias portions 182 outward through outer surface 188 of lock 160, but outward ends 191 of bores 189 may be swaged (i.e., bent or shaped) to prevent portions 182 from leaving bores 189. As shown, elastomeric portions 183 may be springs. Alternatively, elastomeric portions may be rubber, foam, or another type of elastic material.

Figure 12:
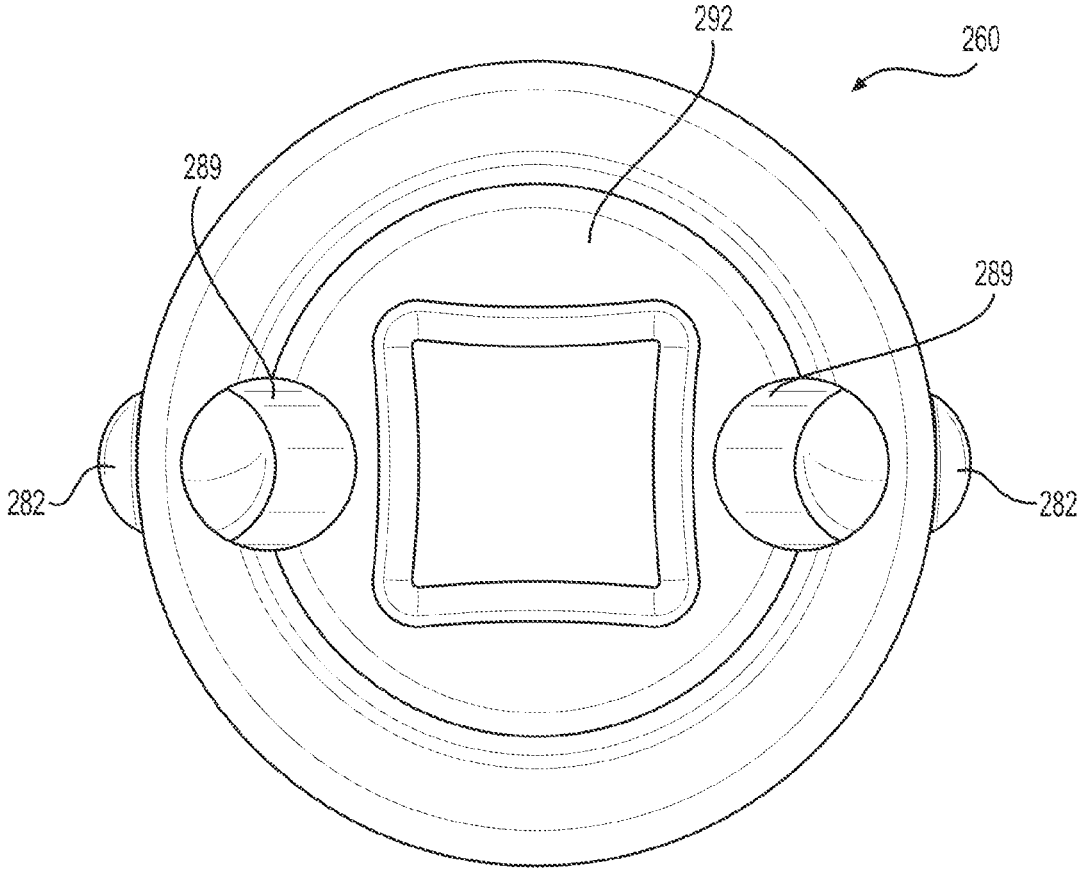
FIG. 12 is a top view of a lock according to yet another exemplary embodiment of the present disclosure.

FIG. 12 illustrates a lock 260 according to another exemplary embodiment. Lock 260 may differ from lock 160 only in that at least partially sphere-shaped portions 282 may be at least partially situated within bores 289 that are open to a top surface 292 of lock 260. Such bores 289 may allow portions 282 to be installed in bores 289 before or after outward ends 291 of bores 289 are swaged.

Figure 13:
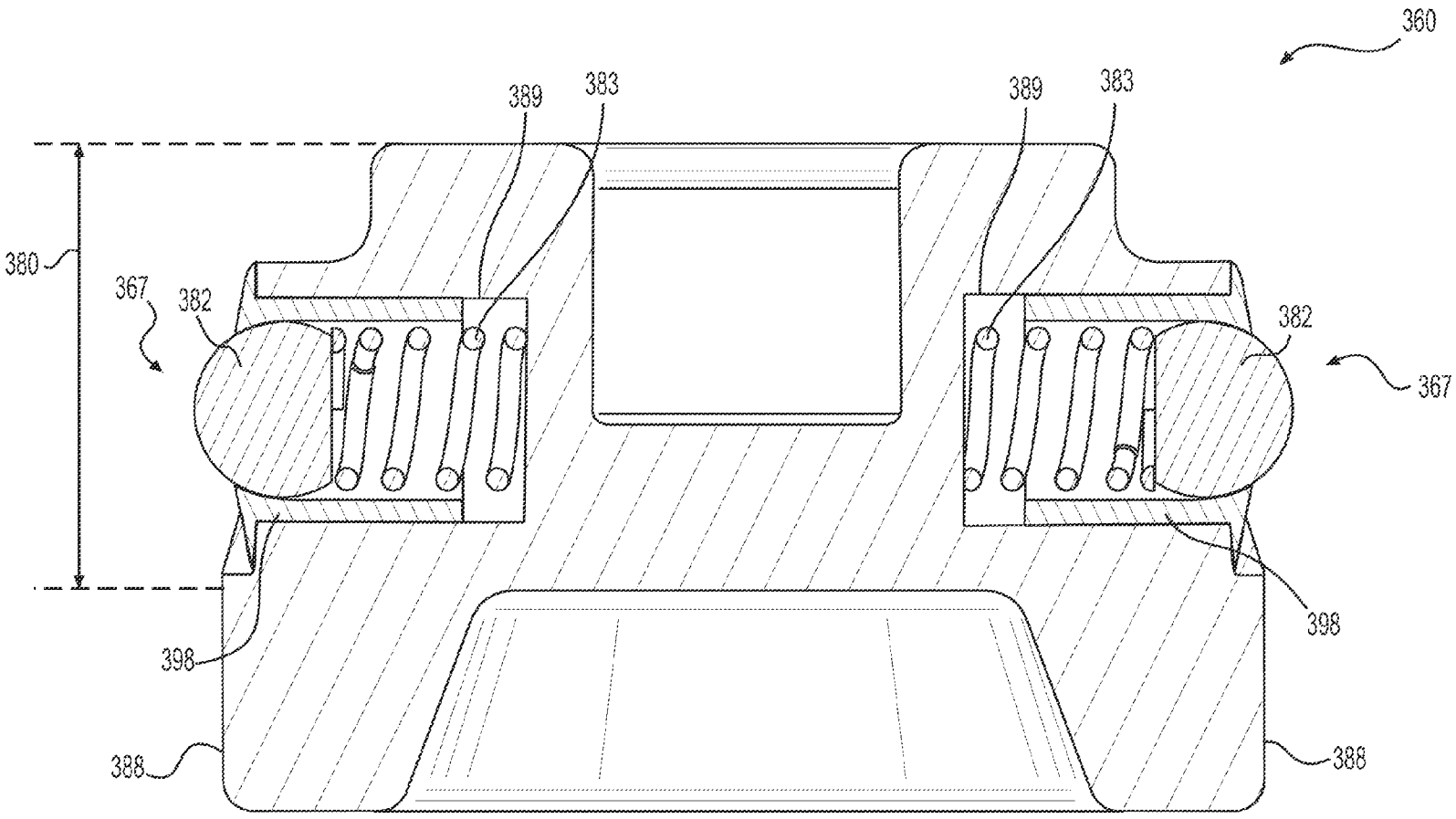
FIG. 13 is a cross-sectional view of a lock according to yet another exemplary embodiment of the present disclosure.

FIG. 13 illustrates a lock 360 according to yet another exemplary embodiment. Lock 360 may include an integrally formed head portion 380. As shown in FIG. 13, detent projections 367 of lock 360 may include at least partially sphere-shaped portions 382 at least partially situated within bores 389 of lock 360. In addition, detent projections 367 may include elastomeric portions 383 situated within bores 389. Elastomeric portions 383 may bias portions 382 outward through outer surface 388 of lock 360, but jacket caps 398 may be inserted into bores 389 to prevent portions 382 from leaving bores 389. In some embodiments, jacket caps 398 may be press-fit into bores 389. In other embodiments, jacket caps 398 may be joined to bores 389 with threads. Alternatively, jacket caps 398 may be permanently or removably joined to bores 389 in other ways (e.g., with glue). As shown, elastomeric portions 383 may be springs. Alternatively, elastomeric portions may be rubber, foam, or another type of elastic material.

Figure 14:
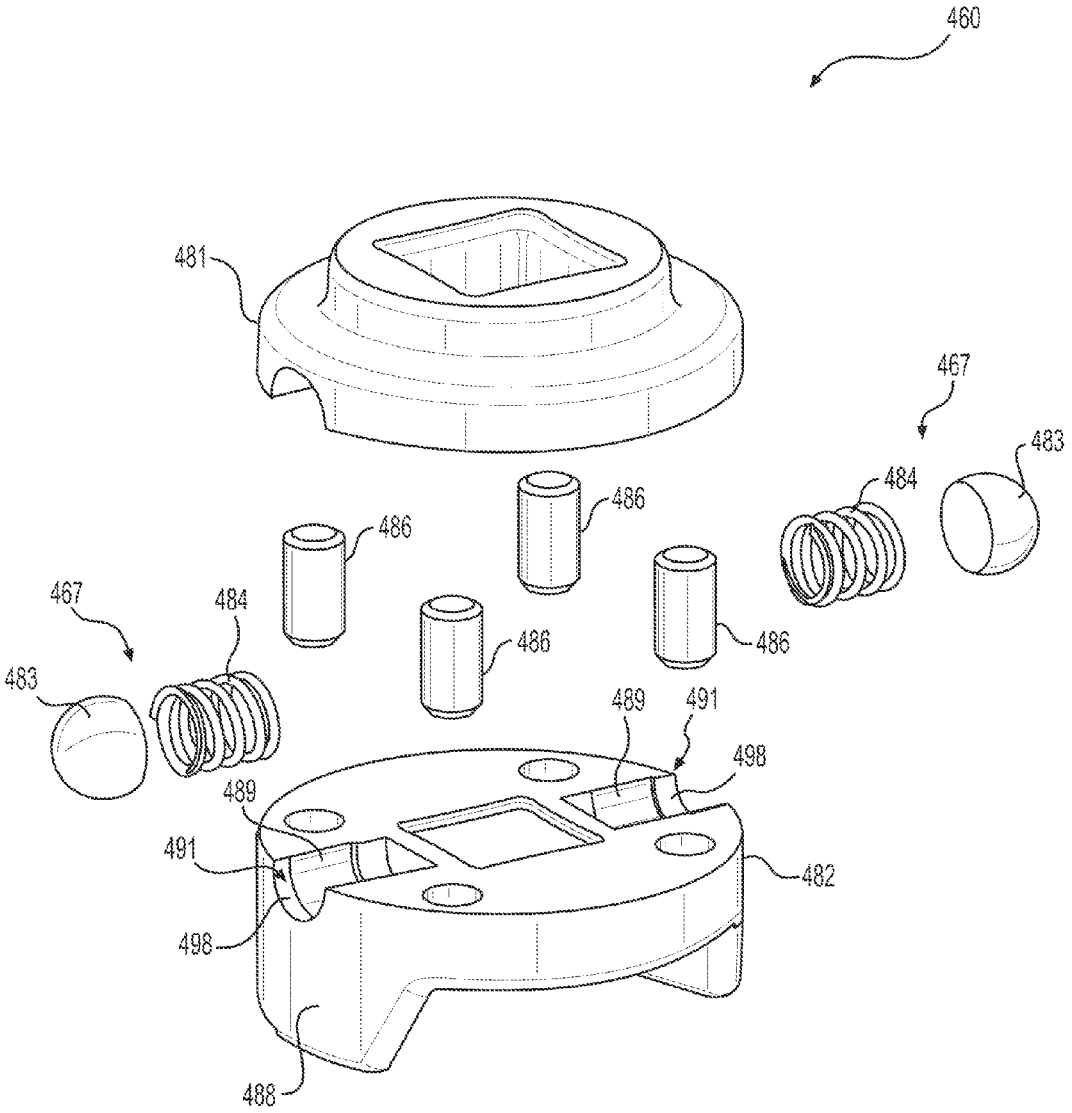
FIG. 14 is an exploded view of a lock according to yet another exemplary embodiment of the present disclosure.

FIG. 14 illustrates a lock 460 according to yet another exemplary embodiment. Lock 460 may include a two-piece head portion, including a top piece 481 and a bottom piece 482, which may be joined together by pins 486. When joined together, top piece 481 and bottom piece 482 may define bores 489. Detent projections 467 of lock 460 may include at least partially sphere-shaped portions 483, which may be at least partially situated within bores 489. In addition, detent projections 467 may include elastomeric portions 484, which may be situated within bores 489. Elastomeric portions 483 may bias portions 483 outward through outer surface 488 of lock 460, but outward ends 491 of bores 489 may include ridges 498 to prevent portions 483 from leaving bores 489. As shown, elastomeric portions 484 may be springs. Alternatively, elastomeric portions may be rubber, foam, or another type of elastic material.

INDUSTRIAL APPLICABILITY

The disclosed retainer systems and ground engaging tool assemblies may be applicable to various earth-working machines, such as, for example, excavators, wheel loaders, hydraulic mining shovels, cable shovels, bucket wheels, bulldozers, and draglines. When installed, the disclosed retainer systems and ground engaging tool assemblies may protect various implements associated with the earth-working machines against wear in the areas where the most damaging abrasions and impacts occur and, thereby, prolong the useful life of the implements.

The disclosed configurations of various components may provide secure and reliable attachment and detachment of ground engaging tools to various earth-working implements, and may have various advantages over previous retainer systems. For example, the disclosed configurations may include fewer parts than previous retainer systems, which include bushings to hold locks in lock cavities. As another example, the disclosed configurations of lock openings and locks may lack the complex shapes of previous retainer systems, simplifying their construction and reducing stress within the components. As yet another example, the metal-on-metal contact between the disclosed detent projections and detent recesses may help retain the disclosed locks in corresponding lock openings during shipment, even in high temperatures that might distort non-metal components. The operation of the disclosed components will now be described.

The disclosed lock 60 is configured to mate with lock opening surface 104, which defines lock opening 40 of tip 30. To attach tip 30 to adapter 20, lock 60 is installed in lock opening 40, into which slot 103 extends, allowing passage of post 23 of adapter 20. Once post 23 is inserted inside lock slot 62, lock 60 is rotated about lock rotation axis 65 to a closed position. In this position, the portion of lock skirt 63 adjacent closed end 68 may preclude sliding frustoconical portion of post 23 into or out of lock slot 62, preventing sliding movement of tip 30 relative to adapter 20. In the locked position, detent projections 67 of lock 60 may engage detent recesses 77 of tip 30, which may releasably hold lock 60 in the locked position.

To detach tip 30 from adapter 20, lock 60 is rotated from the locked position to an unlocked position to cause detent projections 77 and detent recesses 67 to disengage from one another. Once detent projections 77 and detent recesses 67 are disengaged from one another, outer surface 66 of lock 60 may slide along lock opening surface 104 of tip 30, as lock

60 rotates around lock rotation axis 65. Once lock 60 rotates approximately 180 degrees around lock rotation axis 65, detent projections 77 and detent recesses 67 may reengage one another to releasably hold lock 60 in that rotational position.

It will be apparent to those skilled in the art that various modifications and variations can be made to the disclosed embodiments. Other embodiments will be apparent to those skilled in the art from consideration of the specification and practice of the disclosed assemblies. It is intended that the specification and examples be considered as exemplary only, with a true scope being indicated by the following claims and their equivalents.

What is claimed is:

1. A ground engaging tool, comprising:

an interior surface;

an exterior surface defining a front edge of the tool;

a rear surface substantially opposite the front edge, and connecting the interior surface to the exterior surface; and a lock opening surface defining a lock opening extending from the interior surface, through the tool, to the exterior surface, and including:

a groove defined in the lock opening surface and being positioned within the lock opening of the ground engaging tool, the ground engaging tool including at least one detent recess disposed within the groove.

2. The tool of claim 1, wherein the interior surface defines a slot recessed into the tool, and extending from the rear surface to the opening.

3. The tool of claim 1, including a second lock opening surface defining a second lock opening extending from the interior surface, through the tool, to the exterior surface, and having:

a second groove defined in the second lock opening surface and being positioned within the second lock opening of the ground engaging tool, the ground engaging tool including a second detent recess disposed within the second groove.

4. The tool of claim 3, wherein the first and second lock openings are on opposite sides of the tool.

5. The tool of claim 1, wherein the inner portion defines two detent recesses in the tool along the groove.

6. The tool of claim 1, wherein the detent recess is at least partially sphere-shaped.

7. The tool of claim 1, wherein the exterior surface defines a lock/unlock indicator adjacent the lock opening.

8. A ground engaging tool assembly, comprising:

a ground engaging tool, including:

an interior surface;

an exterior surface defining a front edge of the tool;

a rear surface substantially opposite the front edge, and connecting the interior surface to the exterior surface; and a lock opening surface defining a lock opening extending from the interior surface, through the tool, to the exterior surface, and including:

a groove defined in the lock opening and the ground engaging tool including at least one detent recess disposed within the groove;

a lock including a head portion, the head portion including at least one compressible detent projection disposed therein, the lock including a skirt extending from the head portion, the skirt defining a lock slot for receiving a post to be locked with the ground engaging tool;

wherein the at least one detent recess within the groove being structured and arranged to engage the at least one compressible detent projection of the lock corresponding to the lock being in a locked position and rotation of the lock being restricted, and wherein the at least one compressible detent projection being engaged with the groove of the ground engaging tool corresponding to the lock being in a retained condition and translational movement of the lock being restricted.

9. The assembly of claim 8, wherein the head portion and the skirt define an outer surface configured to be rotatably received in the lock opening of the tool, and the at least one compressible detent projection, when not compressed, projects outward from the outer surface.

10. The assembly of claim 9, wherein, when the outer surface of the lock is rotatably received in the lock opening of the tool, the at least one compressible detent projection of the lock engages the groove in the tool.

11. The assembly of claim 10, wherein the exterior surface defines a lock/unlock indicator adjacent the lock opening.

12. The assembly of claim 11, wherein the at least one compressible detent projection of the lock engages the at least one detent recess of the tool when the lock/unlock indicator indicates the post is locked to the tool.

13. The assembly of claim 8, wherein the at least one compressible detent projection includes an at least partially sphere-shaped portion.

14. The assembly of claim 13, wherein the at least one compressible detent projection includes an elastomeric portion biasing the at least partially sphere-shaped portion outward through the outer surface.

* * * * *